US011850879B2

(12) United States Patent
Khaliq

(10) Patent No.: US 11,850,879 B2
(45) Date of Patent: Dec. 26, 2023

(54) FOLDABLE CLIPBOARD

(71) Applicant: Muhammad Sarfraz Khaliq, Brea, CA (US)

(72) Inventor: Muhammad Sarfraz Khaliq, Brea, CA (US)

( * ) Notice: Subject to any disclaimer, the term of this patent is extended or adjusted under 35 U.S.C. 154(b) by 0 days.

(21) Appl. No.: 17/685,357

(22) Filed: Mar. 2, 2022

(65) Prior Publication Data

US 2023/0085864 A1 Mar. 23, 2023

Related U.S. Application Data

(60) Provisional application No. 63/245,804, filed on Sep. 18, 2021.

(51) Int. Cl.
*B42F 9/00* (2006.01)
*B42F 1/02* (2006.01)

(52) U.S. Cl.
CPC ..... *B42F 9/002* (2013.01); *B42F 1/02* (2013.01); *B42F 9/001* (2013.01); *B42P 2241/18* (2013.01); *B42P 2261/00* (2013.01)

(58) Field of Classification Search
CPC ..... B42F 9/001; B42F 9/002
See application file for complete search history.

(56) References Cited

U.S. PATENT DOCUMENTS 4,997,088 A 3/1991 Spry
5,351,992 A 10/1994 Chilson et al.
5,590,910 A 1/1997 Meth
5,671,951 A 9/1997 Palmiter et al.
D415,531 S 10/1999 Schultz
6,439,611 B1 8/2002 Chen
7,225,570 B2 6/2007 Windorski
8,246,080 B1 8/2012 Bennett
D723,799 S 3/2015 Glass et al.
9,296,553 B1 3/2016 Glass
9,764,586 B2 9/2017 Pankow et al.
2003/0034263 A1 2/2003 D'Hoste
2007/0172309 A1 7/2007 Witter et al.
2007/0187565 A1* 8/2007 Liptan ..... B42F 9/001 248/456
2010/0084848 A1* 4/2010 Nguyen ..... B42F 9/001 24/67 R
2012/0073998 A1 3/2012 He
2015/0034799 A1* 2/2015 Krapf ..... B43L 3/008 248/452
2017/0231347 A1 8/2017 Ghanma
2021/0235830 A1 8/2021 Fitzsimmons

* cited by examiner

*Primary Examiner* — Kyle R Grabowski

(74) *Attorney, Agent, or Firm* — Sue C. Watson; Southern Plains IP Law PLLC

(57) ABSTRACT

A foldable clipboard includes a two panel foldable clipboard in which the two panels cooperate to form a single planar surface when in an extended position, and at least one of the two panels are configured to pivotally move to overlap the other when in a folded position, such that the foldable clipboard is folded into a size to fit into a pocket of a garment. The foldable clipboard includes a clip and a holder for a pen or pencil.

12 Claims, 10 Drawing Sheets

FOLDABLE CLIPBOARD

TECHNICAL FIELD

The present invention relates to a foldable clipboard, and more particularly to a two panel foldable clipboard in which the two panels are positioned in a planar position relative to each other in an extended position, and at least one of the two panels is configured to pivotally move to overlap the other panel in a folded position. The foldable clipboard includes a clip for writing material and a holder for a pen or pencil.

BACKGROUND

Clipboards are utilized in a variety of different environments where a portable writing surface may be required. To this end, conventionally known basic clipboards generally consist of a flat panel or board and a clip mounted to one end of the board. The clip retains the writing materials or other documents being written upon against the writing surface provided by the board. Clipboards are an essential mobile writing platform that provides a flat surface for writing or drawing and which incorporates a clip device to secure a sheet of writing material. Clipboards of varying sizes and shapes are available commercially. Existing clipboards are cumbersome to carry due to their relatively large size and are inconvenient to use due to their large size. These clipboards have been restricted to merely carrying a few pages of writing material, and sometimes the pages become torn or damaged because such writing materials are unprotected on regular clipboards. These problems cause difficulty for people who, for example, but not by way of limitation, travel from one location to another, or are research scholars, physicians and/or healthcare workers, or who work outdoors, and the like.

While some of the foregoing are alleviated by computer-based electronics, such as cell phones, computer tablets, and lap top computers, it is not always easy even when utilizing one or more of these options. Typing on cell phones and tablets is not always easy when a person is in a clinic, hospital, or outdoors. While typing can be easier on a laptop computer, they are expensive and bulky to carry into the field. Further, sun light can make the screen of any of these products difficult to see. A low technology option does not carry these problems, except for size and the ability to write on a "regularly-sized" sheet of writing material, i.e., a standard 8.5 inch by 11 inch sheet of writing material. The size of 8.5 inch by 11 inch for a sheet of writing material makes it more difficult to easily store on one's person (such as a pocket) when in the field, for example, but not by way of limitation, when checking electrical lines, water or sewer lines, livestock, land boundaries, and the like.

It would be desirable to have a low technology solution which permitted writing on a regularly-sized sheet of writing material. Such a solution could hold at least several sheets of writing material, and such a solution would desirably be foldable to protect the writing material and prevent it from being crumpled or damaged. Such a foldable solution would also desirably retain the writing material thereon in confidentiality when folded. Yet, the foldable solution would ideally fit within a pocket, a purse, and the like.

SUMMARY

In a first embodiment of the present invention, a foldable clipboard comprises a first folding panel and a second folding panel, which together cooperate to form a single planar surface when in an extended position. The foldable clipboard also includes a pair of hinges. Each hinge has an outer leg bracket and an inner leg bracket pivotally connected together. Each outer leg bracket of each hinge of the pair of hinges is connected to the first folding panel, and each inner leg bracket of each hinge of the pair of hinges is connected to the second folding panel. When the first folding panel and the second folding panel are in the extended position, the first folding panel and the second folding panel are positioned at a substantially 180 degree angle relative to each other via the pivotal movement of the pair of hinges and the abutment of the first folding panel against the second folding panel to form the single planar surface of the clipboard in the extended position. At least one of each outer leg bracket and each inner leg bracket of each hinge of the pair of hinges is positioned on a flange extending from a side of the first folding panel. When in the fully folded position, each of the inner leg brackets of each of the first and second hinges is positioned against a portion of each of the respective outer leg brackets of the first and second hinges, respectively, to form a space between the first and second folding panels to provide a substantially parallel position of the first folding panel and the second folding panel relative to each other when in the folded position.

In an aspect of the first embodiment, a portion of each outer leg bracket and a portion of each inner leg bracket of each hinge of the pair of hinges forms a stop to prevent each outer leg bracket and each inner leg bracket from completely overlapping each other when in the folded position. When the foldable clipboard in the extended position provides axially aligned first and second folding panels abutted together to form the substantially planar surface of the foldable clipboard.

In other aspects of the first embodiment, each outer leg bracket and each inner leg bracket of the pair of hinges is positioned on a flange. Each outer leg bracket of the pair of hinges is positioned on a flange formed on the first and second side edges of the first folding panel, and each inner leg bracket of the pair of hinges is positioned on a flange formed on the first and second side edges of the second folding panel.

In another aspect of the first embodiment, the foldable clipboard further comprises a clip, and the clip is a spring-loaded clip that includes a mounting bracket connected to at least an upper surface of the first folding panel, and the spring-loaded clip includes a handle that is frictionally positioned against the bracket.

In a further aspect of the first embodiment, wherein when the folding clipboard is in the extended position, a lower edge of the first folding panel abuts an upper edge of the second folding panel.

In yet another aspect of the first embodiment of the foldable clipboard, a pair of ends of the first folding panel are each rounded, and a pair of ends of the second folding panel are each rounded.

In another aspect of the first embodiment of the foldable clipboard, the first folding panel and the second folding panel are each constructed from at least one of metal, plastic, and cardboard.

In yet another aspect of the first embodiment of the foldable clipboard, a holder for a pen or pencil is connected to the clipboard.

In a second embodiment of the present invention, a method of making and using a foldable clipboard comprises providing a first folding panel and a second folding panel. The method also comprises connecting together the first folding panel and the second folding panel via a pair of hinges that are connected to both the first folding panel and the second folding panel. Each hinge has an outer leg bracket and an inner leg bracket pivotally connected together. Each outer leg bracket of each hinge of the pair of hinges is connected to the first folding panel, and each inner leg bracket of each hinge of the pair of hinges is connected to the second folding panel. The method further includes pivotally moving the foldable clipboard from a folded position to an extended position by pivotally moving one of the first folding panel and the second folding panel away from the other which acts to pivotally move each inner leg bracket of each hinge of the pair of hinges away from each outer leg bracket of each hinge to achieve about a 180 degree angle relative to each hinge. The method further comprises abutting and aligning a lower edge of the first folding panel to an upper edge of the second folding panel, forming a single planar surface in an extended position for use of the foldable clipboard.

In one aspect of the second embodiment, the method includes the step of pivotally moving the foldable clipboard from the extended position to the folded position by pivoting at least one of the first folding panel and the second folding panel to overlap the other. Each outer leg bracket and each inner leg bracket of each hinge pivoting from the extended position at the about 180 degree angle to a position overlapping at least a portion of each inner leg bracket and each outer leg bracket. An upper surface of the at least one of the first folding panel and the second folding panel is moved adjacent to an upper surface of the other. 13. The method of claim 12, wherein in the step of pivotally moving the foldable clipboard from the extended position to the folded position, a portion of each outer leg bracket and a portion of each inner leg bracket of each hinge of the pair of hinges forms a stop to prevent each outer leg bracket and each inner leg bracket from completely overlapping each other. In addition, in the step of pivotally moving the foldable clipboard from the extended position to the folded position, the stop of each hinge permits the first folding panel to be substantially parallel with the second folding panel in the folded position.

In another aspect of the second embodiment, in in the step of pivotally moving the foldable clipboard from a folded position to an extended position, the first folding panel and the second folding panel abut together to form the substantially planar surface of the foldable clipboard.

In a further aspect of the second embodiment, in the step of pivotally moving the foldable clipboard from a folded position to an extended position, each inner leg bracket of each hinge of the pair of hinges is positioned on a flange formed on each first and second side edge of the second folding panel.

In yet another aspect of the second embodiment, the method further includes positioning a spring-loaded clip that includes a mounting bracket on an upper surface of the first folding panel. The spring-loaded clip includes a handle that is frictionally positioned against the bracket of the clip.

In a further aspect of the second embodiment, in the step of providing a first folding panel and a second folding panel, a pair of ends of the first folding panel are each rounded, and a pair of ends of the second folding panel are each rounded.

In still a further aspect of the second embodiment, in the step of providing a first folding panel and a second folding panel, at least one of the first folding panel and the second folding panel comprises at least one of metal, plastic, and cardboard.

In still yet another aspect of the second embodiment, the method further comprises providing a holder carried by the foldable clipboard.

BRIEF DESCRIPTION OF THE DRAWINGS

The structure, operation, and advantages of the present invention will become further apparent upon consideration of the following description taken in conjunction with the accompanying figures. The figures are intended to be illustrative, and not limiting.

DETAILED DESCRIPTION OF THE PREFERRED EMBODIMENTS

Figure 1:
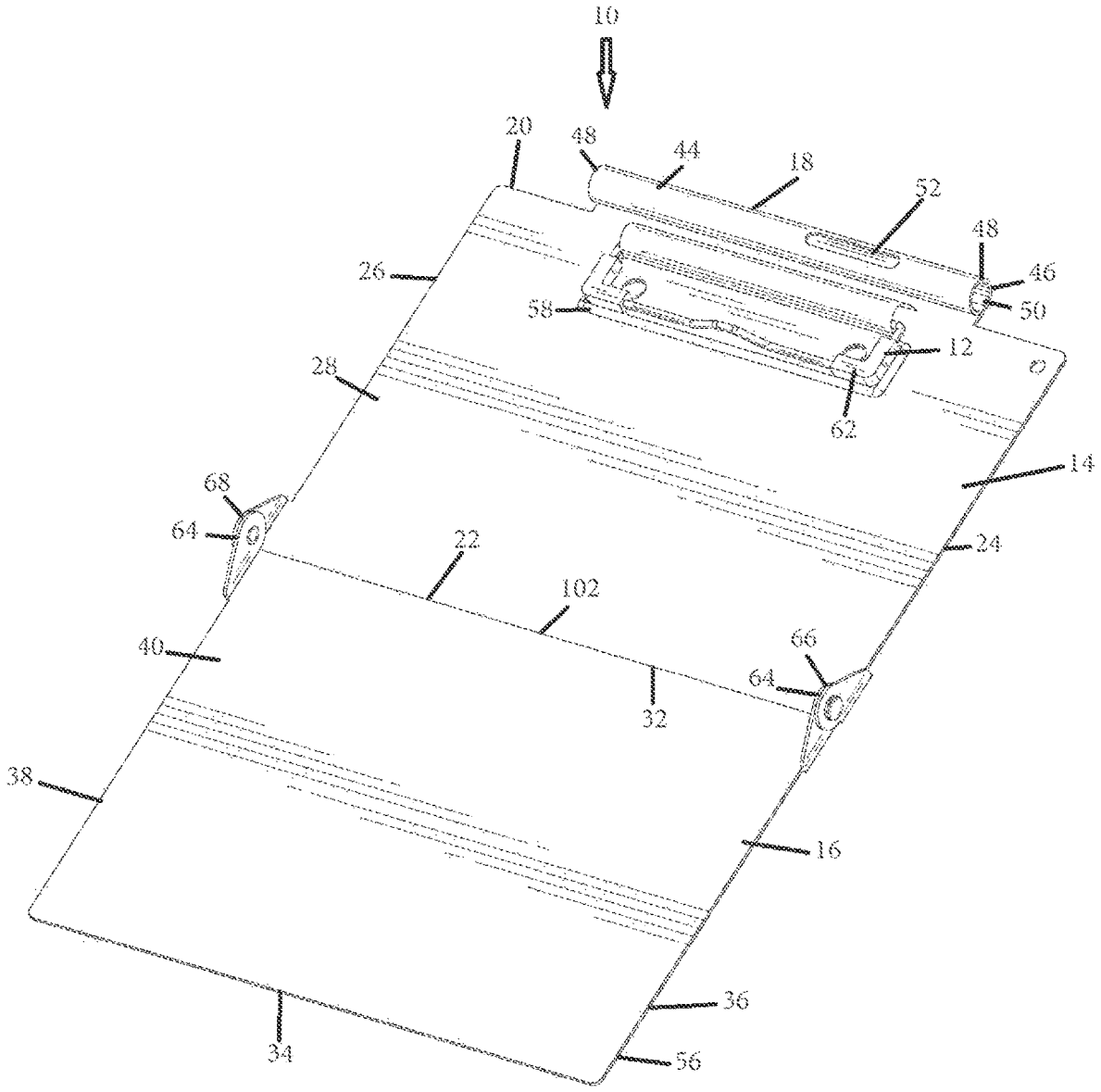
FIG. 1 is an upper surface perspective view of the foldable clipboard in an open position, according to the present invention, a holder for a pen or pencil positioned on an upper edge thereof.

In the description that follows, numerous details are outlined to provide a thorough understanding of the present invention. It will be appreciated by those skilled in the art that variations of these specific details are possible while still achieving the results of the present invention.

Exemplary illustrative embodiments of the invention should be interpreted as example(s) and non-limiting. The relationship between various components, where they are located, their composition(s), their operation, and sometimes their sizes relative to the desired operation of the invention are significant.

The foldable clipboard 10 is designed as an improvement to a traditional flat, rigid clipboard and other known clipboards. It is designated as a "mini" foldable clipboard 10 because it can be folded to a size which is reasonable to place, for example, but not by way of limitation, in a suit jacket pocket, a laboratory coat pocket, a standard coat pocket, a pants pocket, a purse, and the like. The foldable clipboard 10 is of particular use to doctors and medical personnel because the foldable clipboard 10 can be folded in two (2) layers to comfortably fit into a medical coat pocket, a scrubs pocket, and even a jeans pocket. For example, the foldable clipboard 10 may be utilized to secure patient assessment forms, nursing protocols, medication lists, and all documentation in a HIPAA compliant secure foldable clipboard. However, it is within the disclosure of the embodiment that the foldable clipboard 10 may also be used to accommodate the needs of a variety of different people in a variety of services or work environments, as described in non-limiting examples herein. While it is desirable that the foldable clipboard 10 is configured to hold a writing material having an approximately 8.5 by 11 inch outer diameter, it will also be understood that the foldable clipboard may include various sizes to accommodate different-sized writing materials.

Referring now to FIGS. 1 to 10, the foldable clipboard 10 includes a clip 12, as well as a first folding panel 14, a second folding panel 16, and a holder 18 for a pen or pencil. The first folding panel 14 and the second folding panel 16 are planar. Further, each panel 14, 16 are also, for example, but not by way of limitation, substantially rectangular. "Substantially rectangular" as used herein, means that at least eighty (80) percent of the shape is rectangular, but the shape may include minor variations, such as, for example only, flanges, and the like.

The first folding panel 14 includes the clip 12, and the first folding panel 14 is defined by an upper edge 20 and a spaced-apart lower edge 22, a first side edge 24 spaced-apart from a second side edge 26, an upper surface 28 and a lower surface 30.

The second folding panel 16 includes an upper edge 32 and a spaced-apart lower edge 34, and a first side edge 36 spaced-apart from a second a side edge 38. The second folding panel includes an upper surface 40, and a lower surface 42.

Figure 10:
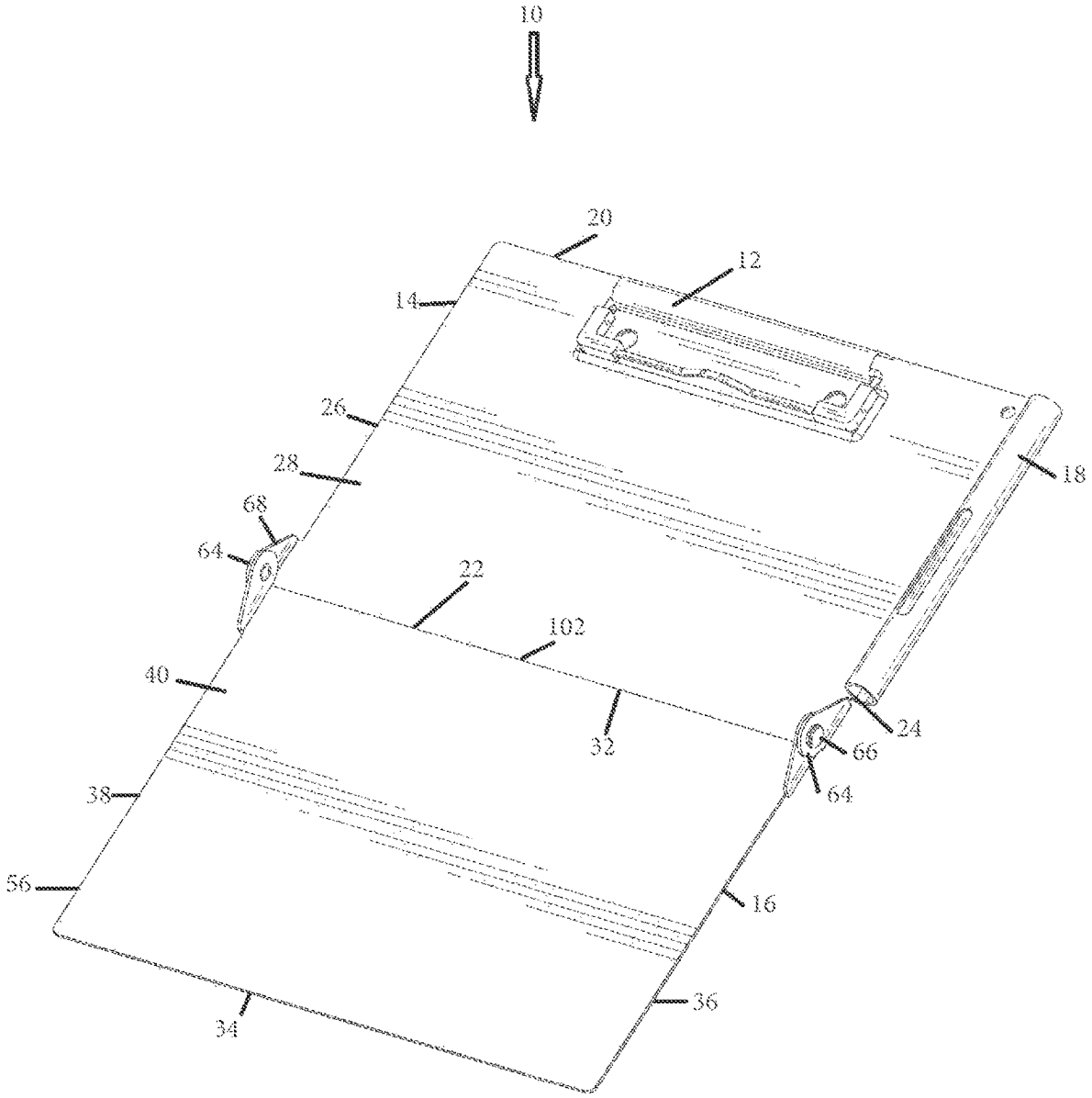
FIG. 10 is an upper surface perspective view of the foldable clipboard of FIG. 1, but showing an alternate position of the holder on one side thereof.

In one embodiment, as shown in FIGS. 1 to 10, the holder 18 is desirably formed with and/or connected to, but not by way of limitation, the upper edge 20 of the first folding panel 14. The holder 18 may be, for example only, cylindrical in shape and the holder 18 includes an outer surface 44 and an opening 46 formed therethrough which forms an inner housing 50 configured to hold a pen or pencil (not shown). A slot 52 in the outer surface 44 of the holder 18 permits a user to see if a pen or pencil is held in the inner housing 50. The holder 18 may also include one or two caps (not shown) to provide a closure for the open ends 48 in order to retain the pen or pencil within the inner housing 50. The holder 18 may be positioned on any edge or area of the foldable clipboard 10 so long as the foldable clipboard operates as shown and described in detail herein. FIG. 10 illustrates a holder 18 connected to a first side edge 24 of the first folding panel 14. However, a holder 18 may also form a clip, a clamp, a slide, or any other container or connector known in the art which holds a pen or pencil and permits the foldable clipboard 10 to function as shown and described in detail herein.

The second folding panel 16 folds over and overlaps the first folding panel 14, therefore, the second folding panel 16 is configured to have about the same dimensions as the first folding panel 14, and each first and second folding panels 14, 16, desirably have a substantially similar size and shape, especially in the fully folded position 54 so that one folding panel 14 and 16 does not extend significantly beyond the limits of the other folding panel 14 and 16. The upper edge 32 of the second folding panel 16 and the lower edge 30 of the first folding panel 14 are positioned to abut each other when in the fully extended position 56.

The clip 12 is positioned desirably and for example, but not by way of limitation, on the upper surface 28 of the first panel 14 near the upper edge 26 thereof, and includes a mechanism, i.e., a clip, to hold writing material (not shown) to the foldable clipboard 10. While one type of clip 12 is illustrated and described in detail herein, it will be appreciated that any low profile clip which holds writing material to the foldable clipboard 10 and does not interfere with the folded position 54 of the clipboard 10 may be used. For example, as illustrated best in FIGS. 1, 2, and 4, the present clip 12 may include a bracket 58 and a pair of connectors 60 which connect the bracket 58 to the foldable clipboard 10. The bracket 58 desirably includes a spring-loaded clip 12 in the form of a handle 60 which is urged toward the foldable clipboard 10. When the handle 62 is raised, writing material (not shown) may be positioned on the foldable clipboard 10 and when the handle 62 is released, the handle 62 is urged toward the foldable clipboard 10 to hold the writing material in a desired position.

The clip 12 and any part(s) thereof may be formed from metal and/or plastic. The clip 12 illustrated herein is commercially available. The clip may be connected to the foldable clipboard via welding, adhesives, connectors (as shown herein) or by any other manner known in the art. More than one clip may be used, and the present clip 12 and/or additional clips may be connected to any surface of the clipboard 10. In addition, paper or other material having releasable adhesive may be connected to the clipboard 10. In this instance, the clipboard may not include the clip 12.

A pair of hinges 64 connect the first folding panel 14 and the second folding panel 16 together. First and second hinges 66, 68, include outer leg brackets 70, 72, and inner leg brackets 74, 76, respectively.

In the first hinge 66, the outer leg bracket 70 is pivotally connected to the inner leg bracket 74 via a pin 78. The outer leg bracket 70 is also connected to the first side edge 24 of the first folding panel 14 near the lower edge 22 thereof. The inner leg bracket 74 is connected to the first side edge 36 of the second folding panel 16 near the upper edge 32 thereof.

Similarly, in the second hinge 68, the outer leg bracket 72 is connected to the inner leg bracket 76 via a pin 79. The outer leg bracket 72 is also connected to the second side edge 26 of the first folding panel 14 near the lower edge 22 thereof. The inner leg bracket 76 is connected to the second side edge 38 of the second folding panel 16 near the upper edge 32 thereof.

Each hinge 66, 68 is a type of knife hinge and may be formed, for example, but not by way of limitation, from metal or plastic. The hinges 66, 68 may be integrally formed with each of the panels 14, 16, as shown and described herein, and the pivot pin 78, 79 added to each later. Alternatively, each hinge 66, 68, may be connected to panels 14, 16, as shown and described in detail herein by welding, adhering, connecting via connectors, and all other forms of connection known in the art. Knife hinges are available commercially. Varying a position of hinges 66, 68 on a surface of a panel rather than an edge of a panel 14, 16, 18 is also enabled herein, as is a variation of size or type of any hinge 66, 68 herein.

Figure 2:
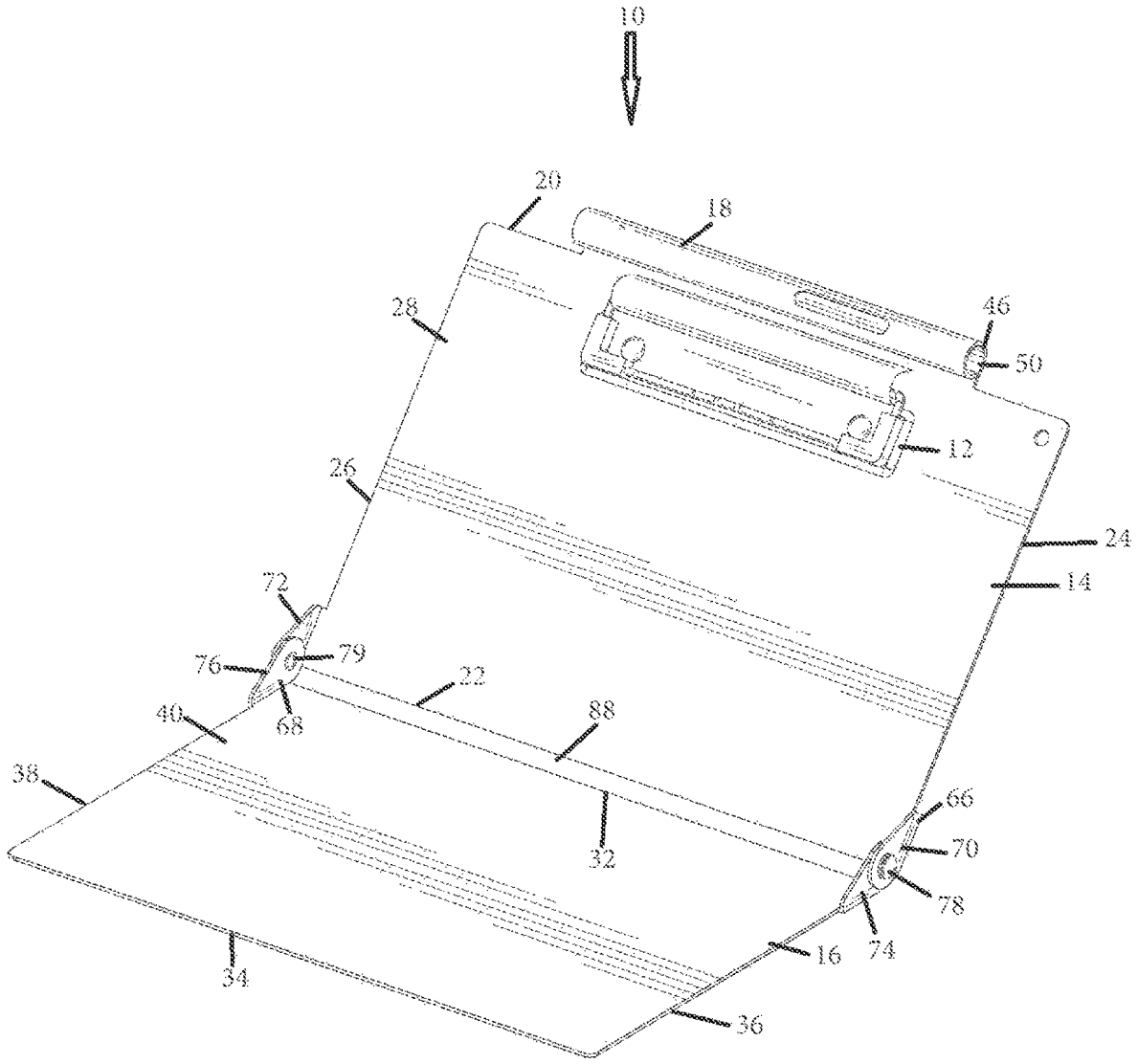
FIG. 2 is a perspective view of a partially folded position of the foldable clipboard of FIG. 1.
Figure 3:
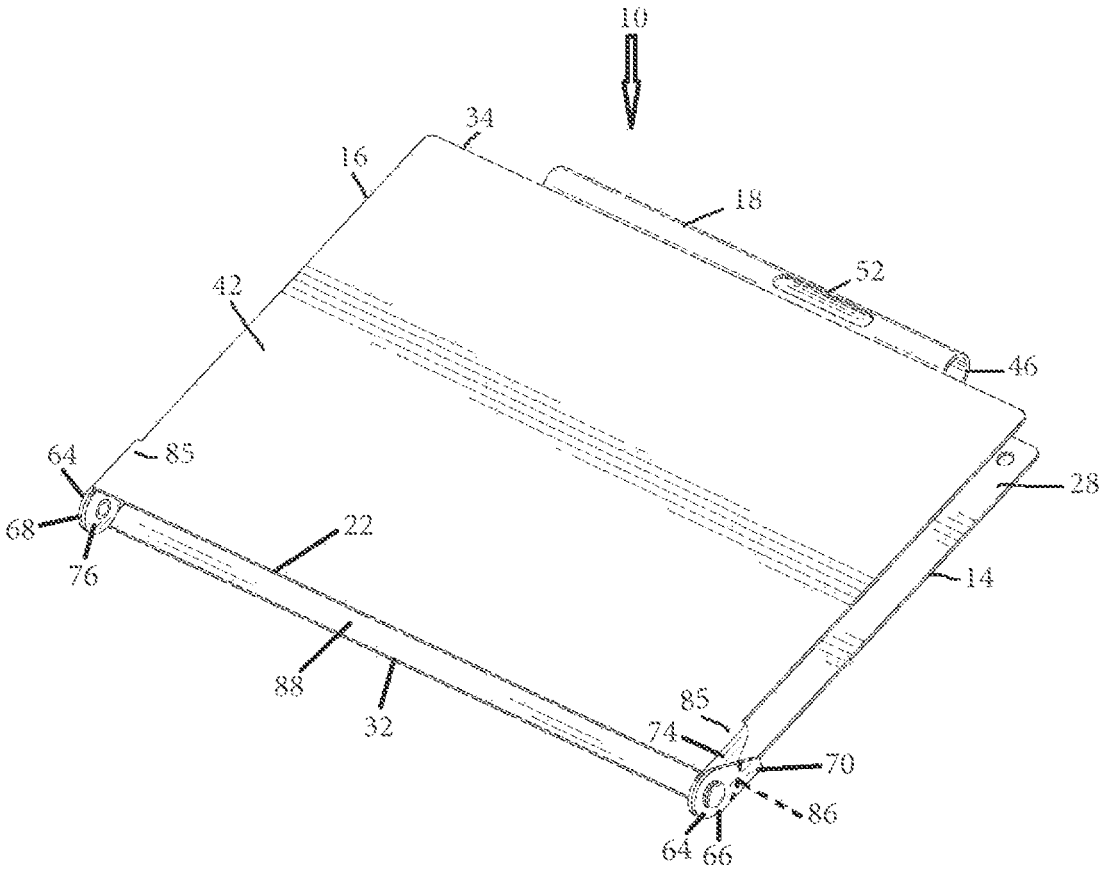
FIG. 3 is a perspective view of a completely folded position of the foldable clipboard of FIGS. 1 and 2.
Figure 4:
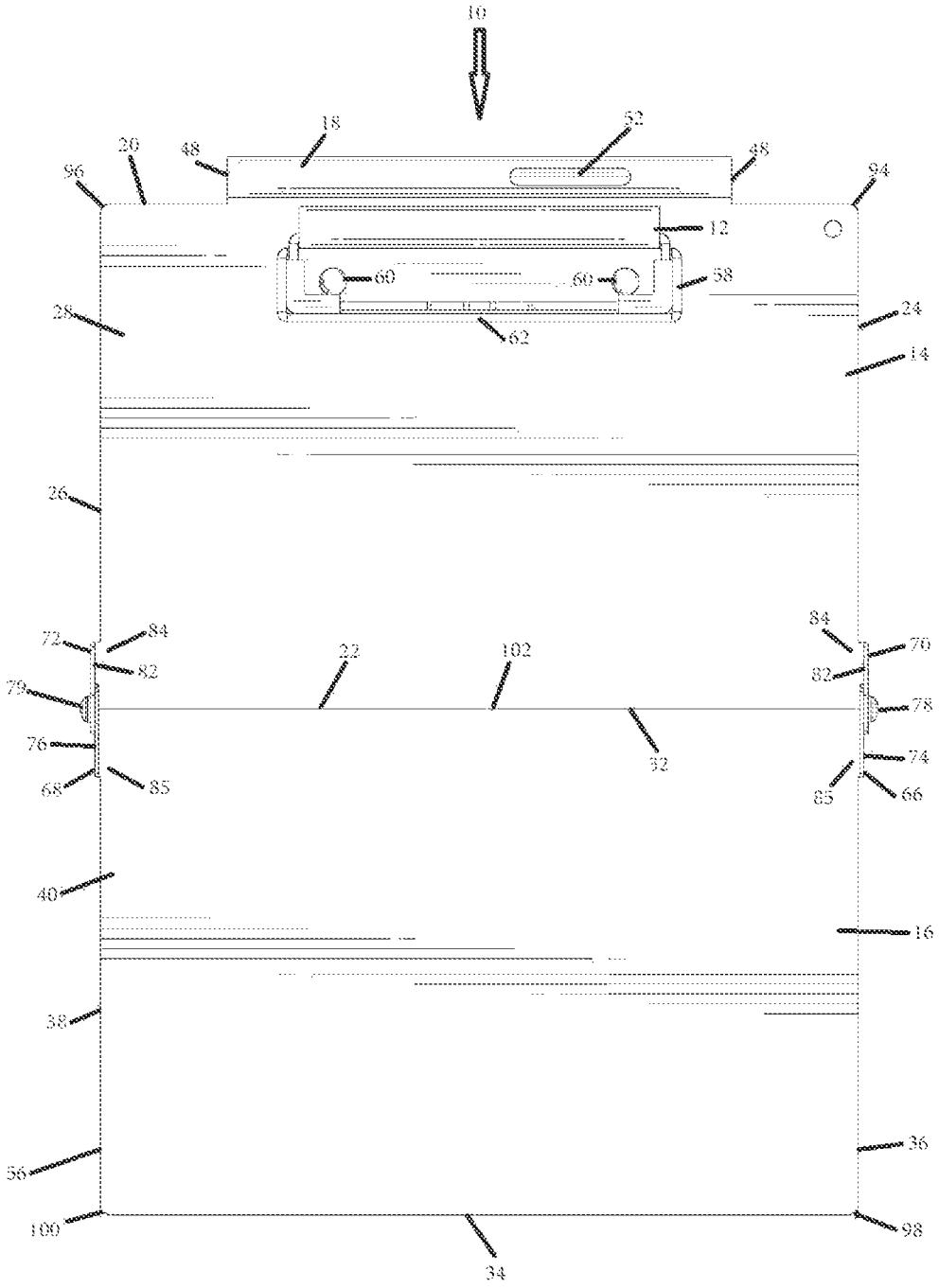
FIG. 4 is a top plan view of an upper surface of the foldable clipboard of FIG. 1.
Figure 5:
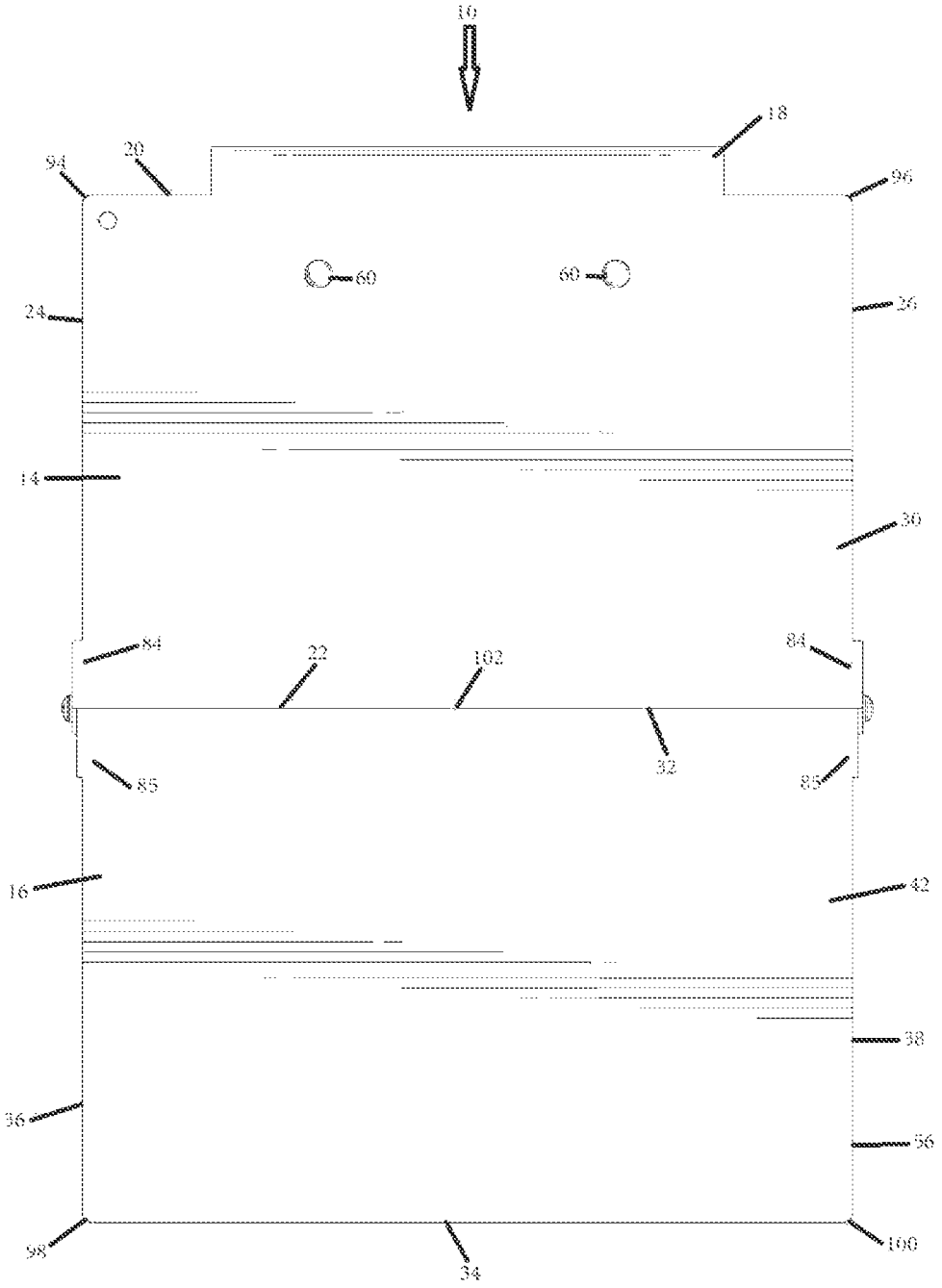
FIG. 5 is a bottom plan view of a lower surface of the foldable clipboard of FIG. 1.
Figure 6:
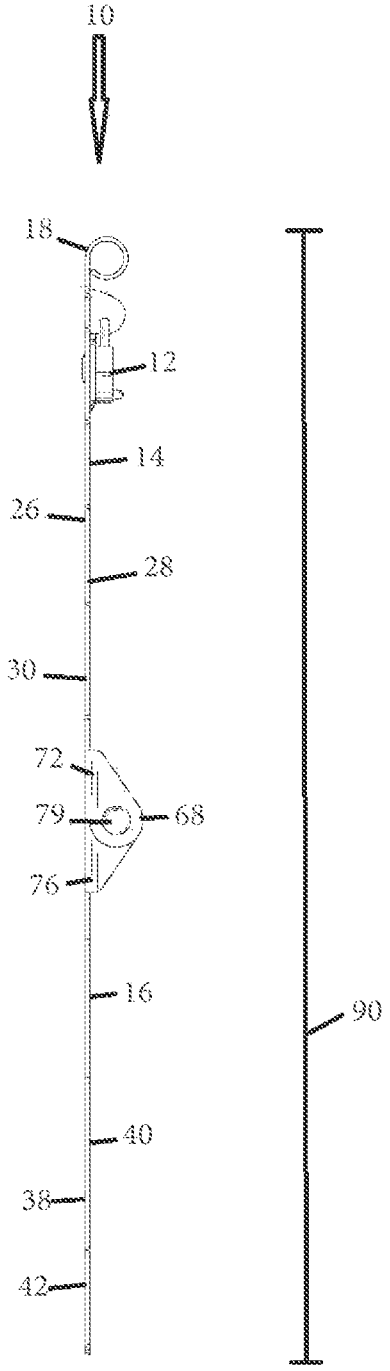
FIG. 6 is a side view of one side of the foldable clipboard of FIG. 1.
Figure 7:
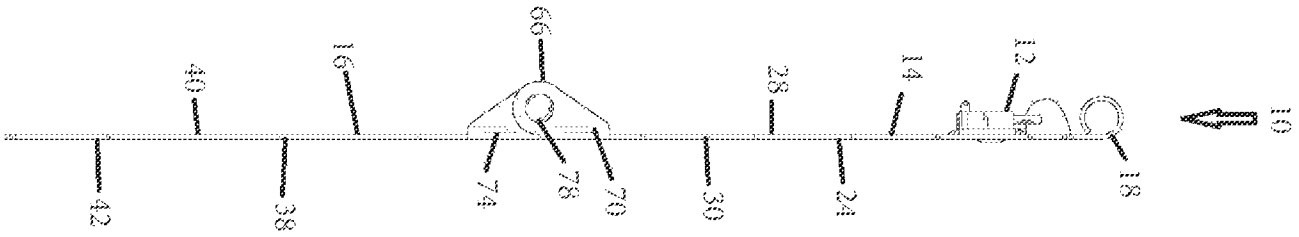
FIG. 7 is an opposite side view of the foldable clipboard of FIG. 1, relative to the side view of FIG. 6.
Figure 8:
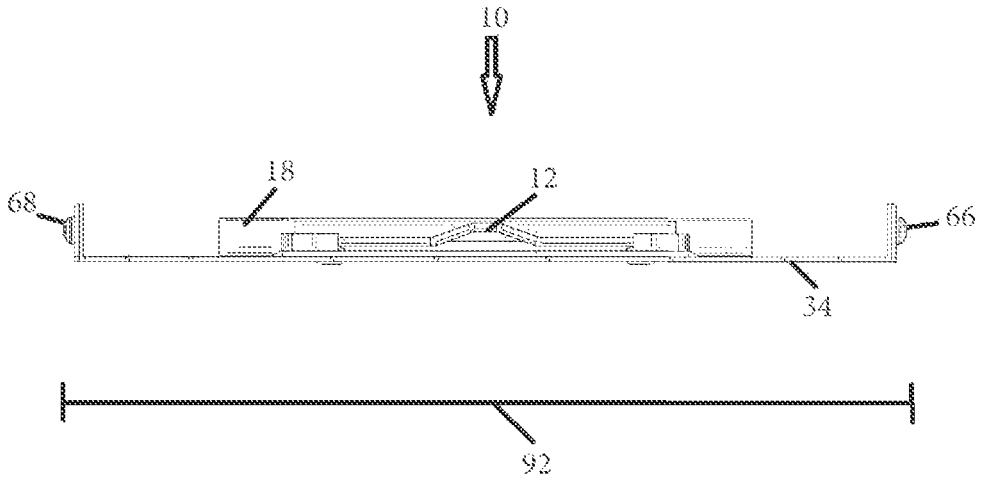
FIG. 8 is a bottom plan view of a lower edge of the foldable clipboard of FIG. 1.
Figure 9:
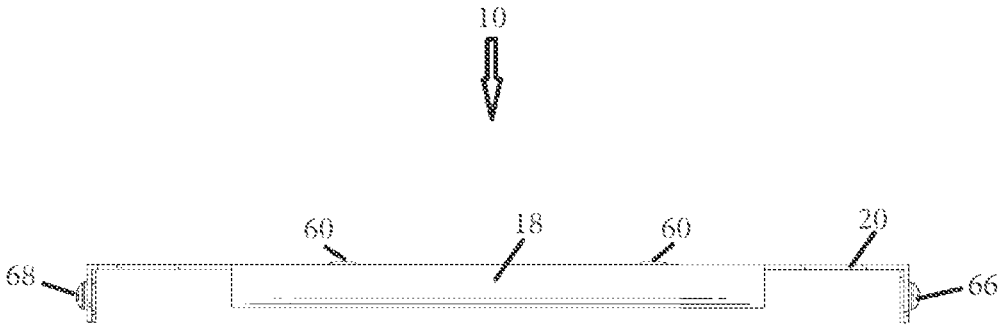
FIG. 9 is a top plan view of an upper edge of the foldable clipboard of FIG. 1.

Referring to FIGS. 1, 2, and 3, each first and second hinge 66, and 68, respectively, are formed to permit each outer leg bracket thereof 70, 72, respectively, and each inner leg bracket thereof 74,76, respectively to overlap at least a portion of each other. Each location and each connection of each first and second hinge 66, 68 are configured to enhance the ability of the foldable clipboard 10 to fold as shown and described herein.

Each inner leg bracket 74, 76, respectively, and each outer leg bracket 70, 72, respectively, of each first and second hinge 66, 68, respectively, is connected to the foldable clipboard along an inner surface 82 of each outer leg bracket 70, 72, respectively, and each inner leg bracket 74, 76, respectively, of each respective first and second hinge 66, 68. Each outer leg bracket 70, 72, of the first and second hinges 66, 68, respectively, may include, or be positioned upon a first flange 84 formed on each side edge 24, 26 of the first folding panel 14 to permit the connection of the outer leg brackets 70, 72 to connect to their respective inner leg brackets 74, 76 which are are each positioned on a second flange 85 formed on each side edge 36, 38 of the second folding panel 16. This positioning permits each inner leg bracket 74, 76, to at least partially overlap (or "inner lap") its respective outer leg bracket 70, 72. Flanges 84. 85 permit the desired partial overlap of the hinges, such that a portion of each hinge acts as a stop 86 (shown in phantom lines in FIG. 3) which is desirably, but not by way of limitation, permits the first and second folding panels to be positioned parallel to each other with a space 88 between each lower edge 22 of the first folding panel 14 and the upper edge 32 of the second folding panel 16.

Referring to FIGS. 1, 2, and 3, and in a method of use, the position of outer leg brackets and inner leg brackets relative to the first folding panel 14 and the second folding panel 16 permit the second folding panel 16 to fold over the first folding panel 14, in a fully closed position 54. That is, the inner leg brackets 74, 76, respectively, of the first and second lower hinges 66, 68, respectively, pivotably move to partially overlap ("inner lap") the outer leg brackets 70, 72, respectively, of the first and second hinges 66, 68, respectively, to permit the second folding panel 16 to fold and overlap the first folding panel 14, as illustrated in FIGS. 2 and 3, or vice versa.

Referring to FIGS. 1 and 4-10, it will be understood that the first and second folding panels 14 and 16, of the foldable clipboard 10 are positioned in the fully extended position 54, the first and second folding panels cooperate to form a single flat, planar surface which is rigid and suitable for securing documents thereon and providing a planar surface for a writing surface to hold writing material (not shown) thereupon. In this configuration, a person can easily hold the folding clipboard in one hand and write on writing material positioned on the planar surface with another hand. When in the fully extended position 56, it will be appreciated that the lower edge 22 of first folding panel 14 abuts the upper edge 32 of the second folding panel 16.

When the foldable clipboard 10 is moved into the fully folded position 54, the foldable clipboard 10 naturally hides any writing materials it is holding, thus helping maintain confidentiality when it is desired, while also protecting the writing material from damage. And, when in the fully folded position 54, the foldable clipboard 10 is sized to be positioned in a pocket, a purse, and the like.

The foldable clipboard 10 may be constructed of any suitable rigid material, such as cardboard, metal, plastic, and combinations thereof. In particular, but not by way of limitations, aluminum provides a very strong, lightweight material that is very durable. Alternatively, plastic also provides a strong and lightweight material that is relatively inexpensive to manufacture. The foldable clipboard 10 may have any desired dimensions which will hold writing material, such as, for example but not by way of limitation, an 8.5 inch by 11 inch piece of paper, when the foldable clipboard 10 is in the fully extended position 56. However, it must be noted that the foldable clipboard 10 should be sized appropriately to accommodate writing material, including smaller or custom-sized writing material. For example, but not by way of limitation, the foldable clipboard 10 may have a length 90 of 12 inches and a width 92 of 9 inches. The depth or thickness of the foldable clipboard 10 may range from 0.5 millimeter to 5 millimeters. It will be understood that other lengths, depths, and widths of the foldable clipboard 10 are possible, so long as the foldable clipboard 10 operates as shown and described in detail herein, and includes the advantages shown and described herein.

Each first and second foldable panel 14, 16 of the foldable clipboard 10 desirably is generally rectangular, and may be configured to be substantially rectangular in shape. For example, first folding panel 14 and second folding panel 16 includes small flanges 84 on each side edge 24, 26, 36, 38, respectively, thereof. The first folding panel 14 may have rounded outer corners 94, 96, and the second folding panel 16 may also have rounded corners 98, 100. Each rounded corner 94, 96, 98, 100 may have, for example, but not by way of limitation, a slope that is about a 30 degree slope. The rounded edges are helpful in allowing the foldable clipboard 10 to smoothly store in a pocket or other enclosure.

When the foldable clipboard 10 is moved into the folded position, as illustrated in FIGS. 2 and 3, the space 86 is formed between the first folding panel 14 and the second folding panel 16. The first and second hinges 66, 68 and the fact that the inner leg brackets 74, 76, partially overlap (or "inner lap") the outer leg brackets 70, 72, provide the space 86, such that the first and second holding panels 14 and 16 are positioned about parallel to each other. The first and second holding panels 14, 16 therefore may have about 1 to 0 degrees angle relative to each other when in the fully folded position 54. However, it will be understood that this desired angle may vary somewhat, such as, for example only, when a large amount of writing material is held on the foldable clipboard 10. Therefore, as used herein, "substantially parallel" or "about parallel", means within a range of between a 0 degree and a 5 degree angle, desirably, the range is between a 0 degree and a 3 degree angle, and more desirably, the range is between a 0 degree and a 1 degree angle.

When the foldable clip board 10 is in the planar fully extended position 54, the first folding panel 14 and the second folding panel 16 cooperate together with the hinges 66, 68 to form a stop 102 which is formed between the lower edge 22 of the first folding panel 14 and the upper edge 32 of the second folding panel 16 which abut each other in the fully extended position 56, to assist in holding the first folding panel 14 and the second holding panel 16 in the planar extended position.

While the clip 12 is positioned on an upper surface 28 of the first folding panel 14, it will be understood that the clip 12 is excluded from the consideration of the planar extended position, and the clip 12 is desirably a low profile clip as illustrated, or could be formed partially or totally within the first panel 14 to more closely conform to the planar formation of the foldable clipboard 10 (not shown). It will be appreciated that a clip 12 may have any configuration, if the clip operates as described and shown herein. Alternatively, a clip 12 may be excluded from the foldable clipboard 10, if, for instance, a writing material including a releasable adhesive on a lower surface thereof is positioned on the folding clipboard 10.

Although the invention has been shown and described concerning a certain preferred embodiment or embodiments, certain equivalent alterations and modifications will occur to others skilled in the art upon the reading and understanding of this specification and the annexed drawings. In particular regard to the various functions performed by the above-described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed concerning only one of several embodiments, such feature may be combined with one or more features of the other embodiments as may be desired and advantageous for any given or particular application.

What is claimed is:

1. A foldable clipboard, including an extended position and a folded position, comprising:

a first folding panel including a pair of first and second side edges and a pair of outer leg brackets, one outer leg bracket connected to a portion of the first side edge and the other leg bracket connected to a portion of the second side edge;

a second folding panel including a pair of first and second side edges and a pair of inner leg brackets, one inner leg bracket connected to a portion of the first side edge, and the other leg bracket connected to a portion of the second side edge;

a pair of connectors, one connector of the pair of connectors connecting the outer leg bracket of the first side edge of the first folding panel to the inner leg bracket of the first side edge of the second folding panel to form a first hinge, and the other connector connecting the outer leg bracket of the second side edge of the first folding panel to the inner leg bracket of the second side edge of the second folding panel to form a second hinge;

wherein each outer leg bracket and each inner leg bracket of the first hinge and the second hinge includes an inner side facing each other, and an outer side positioned opposite to each respective inner side, wherein when the foldable clipboard is moved into a folded position, the inner side of each outer bracket of both the first hinge and the second hinge moves over at least a portion of each outer side of each inner leg bracket of both the first hinges and the second hinge, wherein the first folding panel and the second are moveable to form the folded position, such that one of the first folding panel and the second folding panel overlaps the other to form the folded position, and when in the folded position, the first folding panel is spaced apart from the second folding panel, and wherein when the first folding panel and the second folding panel extends away from each other, a portion of the first folding panel abuts a portion of the second folding panel to form a flat, planar structure of the extended position.

2. The foldable clipboard of claim 1, wherein when the foldable clipboard in the extended position provides axially aligned first and second folding panels abutted together to form the substantially planar surface of the foldable clipboard.

3. The foldable clipboard of claim 2, wherein in the extended position, a lower edge of the first folding panel abuts an upper edge of the second folding panel.

4. The foldable clipboard of claim 1, wherein at least one of the respective pair of outer leg brackets and the pair of inner leg brackets are each positioned on one flange of a pair of opposing flanges positioned on at least one of the first folding panel and the second folding panel.

5. The foldable clipboard of claim 1, further comprising a clip.

6. The foldable clipboard of claim 5, wherein the clip comprises a spring-loaded clip.

7. The foldable clipboard of claim 6, wherein the clip includes a mounting bracket.

8. The foldable clipboard of claim 6, wherein the clip includes a handle that is frictionally positioned against the mounting bracket.

9. The foldable clipboard of claim 1, wherein the first folding panel and the second folding panel include a pair of ends, and each end of each pair of ends is rounded.

10. The foldable clipboard of claim 1, wherein the first folding panel and the second folding panel are each constructed from at least one of metal, plastic, and cardboard.

11. The foldable clipboard of claim 1, wherein a holder is carried by the clipboard.

12. The foldable clipboard of claim 1, wherein when in the extended position, an upper edge of the first folding panel and a lower edge of the second folding panel are parallel relative to each.

* * * * *